US008322466B2

(12) United States Patent
Bird

(10) Patent No.: US 8,322,466 B2
(45) Date of Patent: Dec. 4, 2012

(54) DRILL BITS AND OTHER DOWNHOLE TOOLS WITH HARDFACING HAVING TUNGSTEN CARBIDE PELLETS AND OTHER HARD MATERIALS AND METHODS OF MAKING THEREOF

(75) Inventor: Jay S. Bird, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 205 days.

(21) Appl. No.: 12/522,013

(22) PCT Filed: Jan. 3, 2008

(86) PCT No.: PCT/US2008/050094

§ 371 (c)(1),
(2), (4) Date: Jul. 2, 2009

(87) PCT Pub. No.: WO2008/086083

PCT Pub. Date: Jul. 17, 2008

(65) Prior Publication Data

US 2010/0101866 A1 Apr. 29, 2010

Related U.S. Application Data

(60) Provisional application No. 60/934,948, filed on Jan. 8, 2007.

(51) Int. Cl.
*E21B 10/00* (2006.01)
*B05D 1/12* (2006.01)

(52) U.S. Cl. ..... 175/374; 175/375; 427/180

(58) Field of Classification Search ..... 175/374, 175/375, 425, 434, 435; 427/180; 219/617
See application file for complete search history.

(56) References Cited

U.S. PATENT DOCUMENTS

| | | | | |
|---|---|---|---|---|
| 4,770,907 | A | 9/1988 | Kimura | 427/217 |
| 4,781,770 | A | 11/1988 | Kar | 148/16.5 |
| 4,814,234 | A | 3/1989 | Bird | 428/564 |
| 4,884,477 | A | 12/1989 | Smith et al. | 76/108 A |
| 4,938,991 | A | 7/1990 | Bird | 427/190 |
| 5,405,573 | A | 4/1995 | Clark et al. | 419/35 |
| 5,429,200 | A | 7/1995 | Blackman et al. | 175/371 |
| 5,452,771 | A | 9/1995 | Blackman | 175/353 |
| 5,518,077 | A | 5/1996 | Blackman et al. | 175/353 |
| 5,579,856 | A | 12/1996 | Bird | 175/375 |
| 5,644,956 | A | 7/1997 | Blackman et al. | 76/108.2 |
| 5,755,298 | A | 5/1998 | Langford, Jr. et al. | 175/374 |
| 5,755,299 | A | 5/1998 | Langford, Jr. et al. | 175/375 |
| 5,988,303 | A | 11/1999 | Arfele | 175/374 |
| 6,102,140 | A | 8/2000 | Boyce et al. | 175/374 |

(Continued)

OTHER PUBLICATIONS

International Preliminary Report on Patentability; PCT/US2008/050094; pp. 8, Nov. 26, 2009.

(Continued)

*Primary Examiner* — Cathleen Hutchins
(74) *Attorney, Agent, or Firm* — Baker Botts L.L.P.

(57) ABSTRACT

A hardfacing is provided to protect surfaces of drill bits and other downhole tools. The hardfacing may include tungsten carbide particles or pellets formed with an optimum weight percentage of binding material and dispersed within and bonded to a matrix deposit. The tungsten carbide particles may be formed by sintering or other appropriate techniques. The tungsten carbide particles may have generally spherical shapes, partially spherical shapes or non-spherical shapes.

38 Claims, 7 Drawing Sheets

U.S. PATENT DOCUMENTS

| | | | | |
|---|---|---|---|---|
| 6,138,779 | A | 10/2000 | Boyce | 175/374 |
| 6,170,583 | B1 | 1/2001 | Boyce | 175/374 |
| 6,333,100 | B1 * | 12/2001 | Palmqvist et al. | 428/216 |
| 6,361,739 | B1 | 3/2002 | Sreshta et al. | 419/68 |
| 6,440,358 | B1 | 8/2002 | Sreshta et al. | 419/66 |
| 6,469,278 | B1 | 10/2002 | Boyce | 219/146.1 |
| 6,511,265 | B1 | 1/2003 | Mirchandani et al. | 407/53 |
| 6,564,884 | B2 | 5/2003 | Bird | 175/57 |
| 6,651,756 | B1 * | 11/2003 | Costo, Jr. et al. | 175/374 |
| 6,659,206 | B2 | 12/2003 | Liang et al. | 175/374 |
| 6,845,828 | B2 | 1/2005 | Boyce | 175/420.2 |
| 7,096,978 | B2 | 8/2006 | Dykstra et al. | 175/57 |
| 7,128,773 | B2 | 10/2006 | Liang et al. | 75/236 |
| 2005/0000317 | A1 | 1/2005 | Liang et al. | 75/241 |
| 2005/0109545 | A1 * | 5/2005 | Lockwood et al. | 175/374 |
| 2006/0127269 | A1 | 6/2006 | Caron | 420/431 |
| 2006/0169102 | A1 | 8/2006 | Heinrich et al. | 75/238 |
| 2006/0171837 | A1 | 8/2006 | Heinrich et al. | 419/15 |

OTHER PUBLICATIONS

Examination Report, Application No. GB0912848.9, 3 pages, Jan. 14, 2011.

International Search Report and Written Opinion; PCT/US08/50094; pp. 11, Jun. 25, 2008.

* cited by examiner

DRILL BITS AND OTHER DOWNHOLE TOOLS WITH HARDFACING HAVING TUNGSTEN CARBIDE PELLETS AND OTHER HARD MATERIALS AND METHODS OF MAKING THEREOF

RELATED APPLICATION

This application is a U.S. national stage application of International Application No. PCT/US2008/50094 filed Jan. 3, 2008, which designates the United States of America, which claims the benefit of U.S. Provisional Patent Application Ser. No. 60/934,948 entitled "Drill Bits And Other Downhole Tools With Hardfacing Having Tungsten Carbide Pellets And Other Hard Materials" filed Jan. 8, 2007. The contents of which are hereby incorporated by reference in their entirety.

TECHNICAL FIELD

The present disclosure relates in general to downhole tools with hardfacing having tungsten carbide pellets and other hard materials dispersed within a matrix deposit and, more particularly, to hardfacing having tungsten carbide pellets formed with an optimum percentage of binding material.

BACKGROUND

Since machining hard, abrasion, erosion and/or wear resistant materials is generally both difficult and expensive, it is common practice to form a metal part with a desired configuration and subsequently treat one or more portions of the metal part to provide desired abrasion, erosion and/or wear resistance. Examples may include directly hardening such surfaces (carburizing and/or nitriding) one or more surfaces of a metal part or applying a layer of hard, abrasion, erosion and/or wear resistant material (hardfacing) to one or more surfaces of a metal part depending upon desired amounts of abrasion, erosion and/or wear resistance for such surfaces. For applications when resistance to extreme abrasion, erosion and/or wear of a working surface and/or associated substrate is desired, a layer of hard, abrasion, erosion and/or wear resistant material (hardfacing) formed in accordance with the present disclosure may be applied to the working surface to protect the associated substrate.

Hardfacing may be generally defined as a layer of hard, abrasion resistant material applied to a less resistant surface or substrate by plating, welding, spraying or other well known deposition techniques. Hardfacing is frequently used to extend the service life of drill bits and other downhole tools used in the oil and gas industry. Tungsten carbide and various alloys of tungsten carbide are examples of hardfacing materials widely used to protect drill bits and other downhole tools associated with drilling and producing oil and gas wells.

Hardfacing is typically a mixture of a hard, wear-resistant material embedded in a matrix deposit which may be fused with a surface of a substrate by forming metallurgical type bonds to ensure uniform adherence of the hardfacing with the substrate. For some applications, wear resistant material such as an alloy of tungsten carbide and/or cobalt may be placed in a steel tube which serves as a welding rod during welding of hardfacing with a substrate. This technique of applying hardfacing may sometimes referred to as "tube rod welding." Tungsten carbide/cobalt hardfacing applied with tube rods has been highly successful in extending the service life of drill bits and other downhole tools.

A wide variety of hardfacing materials have been satisfactorily used on drill bits and other downhole tools. Frequently used hardfacing materials include sintered tungsten carbide particles in a steel alloy matrix deposit. Tungsten carbide particles may include grains of monotungsten carbide, ditungsten carbide and/or macrocrystalline tungsten carbide. Prior tungsten carbide particles have typically been formed with no binding material (0% by weight of binding material) or with relative high percentages (5% or greater) by weight of binding material in such tungsten carbide particles. Spherical cast tungsten carbide may typically be formed with no binding material. Examples of binding materials used to form tungsten carbide particles may include, but are not limited to, cobalt, nickel, boron, molybdenum, niobium, chromium, iron and alloys of these elements.

For some applications loose hardfacing materials may be placed in a hollow tube or welding rod and applied to a substrate using conventional welding techniques. As a result of the welding process, a matrix deposit including both metal alloys from melting associated surface portions of the substrate and from melting metal alloys associated with the welding rod or hollow tube may bond with the hardfacing materials. Various alloys of cobalt, nickel, copper and/or iron may form portions of the matrix deposit. Other heavy metal carbides and nitrides, in addition to tungsten carbide, have been used to form hardfacing.

SUMMARY

The present disclosure provides drill bits and other downhole tools with hardfacing that may provide substantially enhanced performance as compared with prior hardfacing materials. In accordance with the present disclosure, such hardfacing may include tungsten carbide particles formed with an optimum amount of binding material having a weight percentage between approximately three percent (3%) and less than five percent (5%) of each tungsten carbide particle. Other particles of superabrasive and/or superhard materials may also be metallurgically bonded with a deposit matrix to form such hardfacing. Examples of hard particles satisfactory for use with the present disclosure may include encrusted diamond particles, coated diamond particles, silicon nitride ($Si_3N_4$), silicon carbide (SiC), boron carbide ($B_4C$) and cubic boron nitride (CBN). Such hard particles may be dispersed within and bonded to the deposit matrix.

One aspect of the present disclosure may include providing a drill bit and other downhole tools with layers of hardfacing having tungsten carbide particles with an optimum percentage of binding material disposed in the hardfacing. The resulting hardfacing may be able to better withstand abrasion, wear, erosion and other stresses associated with repeated use in a harsh, downhole drilling environment.

Technical advantages of the present disclosure include providing a layer of hardfacing material on selected portions of a drill bit and other downhole tools to prevent undesired wear, abrasion and/or erosion of protected portions of the drill bit.

Further aspects of the present disclosure may include mixing coated or encrusted diamond particles with tungsten carbide particles having an optimum weight percentage of binding materials to provide enhanced hardfacing on a drill bit or other downhole tool. For some applications conventional tungsten carbide particles having more than 5% by weight of binder or approximately 0% by weight of binder may be mixed with tungsten carbide particles having an optimum weight percentage of binder to form one or more layers of hardfacing on a drill bit or other downhole tool. The use of conventional tungsten carbide particles with tungsten carbide particles incorporating teachings of the present disclosure may be appropriate for some downhole drilling operating conditions.

Other technical advantages will be readily apparent to one skilled in the art from the following figures, descriptions and claims.

BRIEF DESCRIPTION OF THE DRAWINGS

For a more complete understanding of the present disclosure and its advantages thereof, reference is now made to the following brief description, taken in conjunction with the accompanying drawings and detailed description, wherein like reference numerals represent like parts, in which.

DETAILED DESCRIPTION

Figure 1:
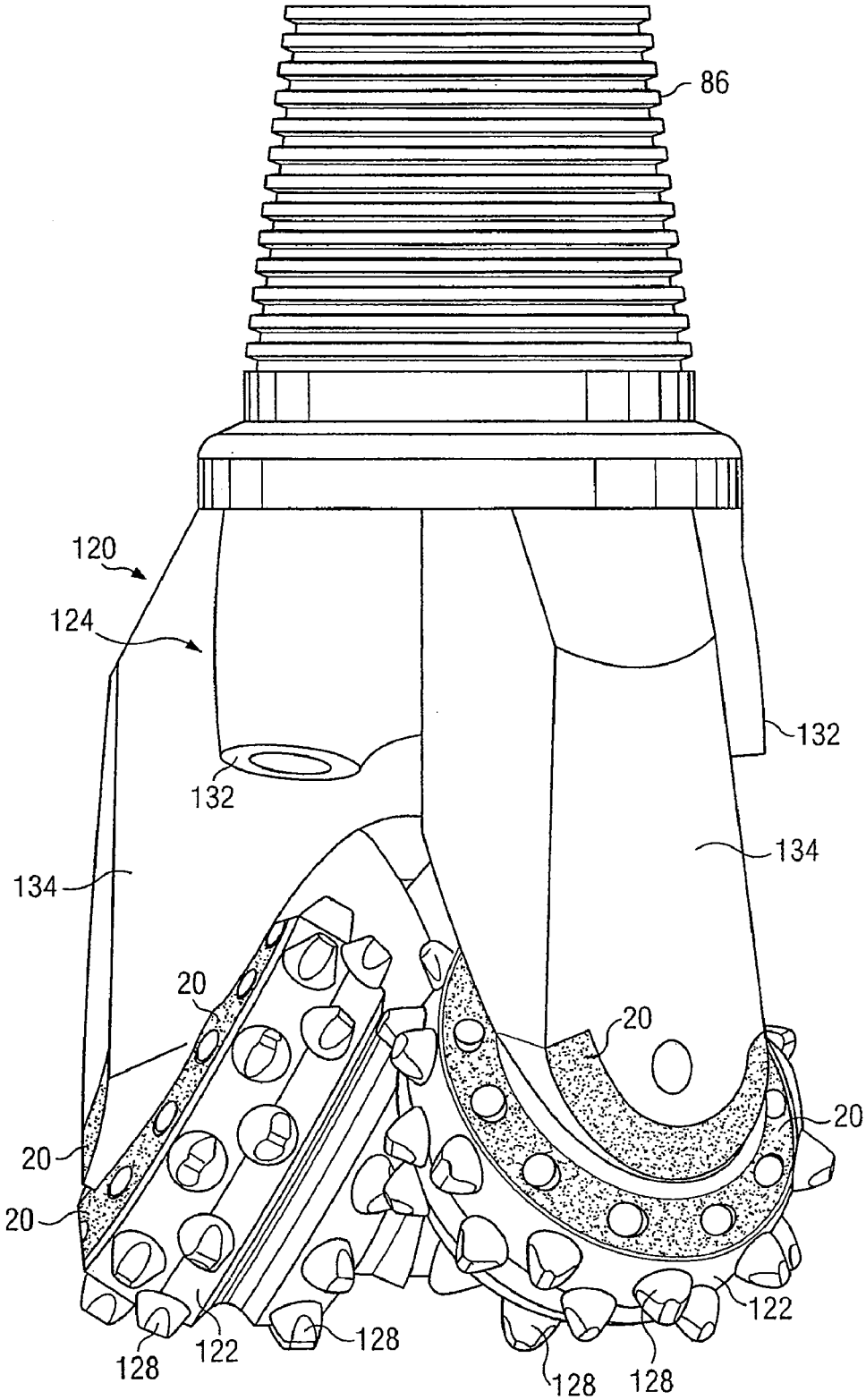
FIG. 1 is a schematic drawing in elevation showing another type of drill bit with hardfacing formed in accordance with teachings of the present disclosure.

The preferred embodiments and their advantages may be best understood by referring in more detail to FIGS. 1-11 of the drawings, in which like numerals refer to like parts.

The terms "matrix deposit," "metallic matrix deposit" and/or "hardfacing" may refer to a layer of hard, abrasion, erosion and/or wear resistant material disposed on a working surface and/or substrate to protect the working surface and/or substrate from abrasion, erosion and/or wear. A matrix deposit may also sometimes be referred to as "metallic alloy material" or as a "deposit matrix." Various binders and/or binding materials such as cobalt, nickel, copper, iron and alloys thereof may be used to form a matrix deposit with hard, abrasion resistant materials and/or particles dispersed therein and bonded thereto. For example, various types of tungsten carbide particles having an optimum weight percentage of binder or binding material may be included as part of a matrix deposit or layer of hardfacing in accordance with the teachings of the present disclosure. A matrix deposit may be formed from a wide range of metal alloys and hard materials.

The term "tungsten carbide" may include monotungsten carbide (WC), ditungsten carbide ($W_2C$), macrocrystalline tungsten carbide.

The terms "tungsten carbide pellet," "WC pellet," "tungsten carbide pellets" and "WC pellets" may refer to nuggets, spheres and/or particles of tungsten carbide formed with an optimum weight percentage of binding material in accordance with the teachings of the present disclosure. The terms "binder", "binding material" and/or "binder materials" may be used interchangeably in this Application.

For some applications tungsten carbide pellets may have generally spherical configurations (see FIGS. 7C and 8C) with a weight percentage of binder between approximately four percent (4%) plus or minus one percent (1%) of the total weight of each tungsten carbide pellet in accordance with teachings of the present disclosure. Tungsten carbide pellets may also be formed with an optimum weight percentage of binder and various non-spherical or partially spherical configurations (not expressly shown).

Spherical tungsten carbide pellets formed with no binding material or 0% binder frequently tend to crack and/or fracture during formation of a matrix deposit or hardfacing layer containing such particles. Tungsten carbide pellets formed with no binding material or 0% binder may also fracture or crack when exposed to thermal stress and/or impact stress. Spherical tungsten carbide pellets formed with relatively high percentages (5% or greater) by weight of binding material or binder may tend to break down or dissolve into solution during formation of an associated matrix deposit or hardfacing layer. As a result, such spherical tungsten carbide pellets and associated matrix deposit or hardfacing layer may have less abrasion, erosion and/or wear resistance than desired and crack when exposed to thermal stress and/or impact stress.

Tungsten carbide pellets formed with an optimum percentage of binding material or binder may neither crack nor dissolve into solution in an associated matrix deposit during formation of the matrix deposit (hardfacing). Spherical tungsten carbide pellets formed with an optimum percentage of binding material and/or binder may also neither crack nor fracture when exposed to thermal stress and/or impact stress. Forming tungsten carbide pellets with an optimum weight percentage of binding material in accordance with teachings of the present disclosure may improve weldability of such hardfacing materials and may substantially improve temperature stress resistance and/or impact stress resistance of the tungsten carbide pellets to fracturing and/or cracking.

For some applications a matrix deposit or hardfacing formed with spherical tungsten carbide particles having an optimum weight percentage of binder have shown improved wear properties during testing of associated hardfacing and/or matrix deposits. For such applications the improvement in wear properties may increase approximately forty-five percent (45%) during wear testing in accordance with ASTM B611 as compared with a matrix deposit or hardfacing having spherical tungsten carbide particles with binding material representing five percent (5%) or greater the total weight of each tungsten carbide particle. One example of such tests is shown in attached Schedule A.

A matrix deposit and/or hardfacing may be formed with tungsten carbide pellets having an optimum weight percentage of binding material in a wide range of mesh sizes. For some applications the size of such tungsten carbide pellets may vary between approximately 12 U.S. mesh and 100 U.S. mesh. The ability to use a wide range of mesh sizes may substantially reduce costs of manufacturing such tungsten carbide pellets and costs associated with forming a deposit matrix or hardfacing with such tungsten carbide pellets. For example, tungsten carbide pellets 30 as shown in FIG. 7C or 8C may have a size range from approximately 12 to 100 U.S. Mesh.

Figure 7C:
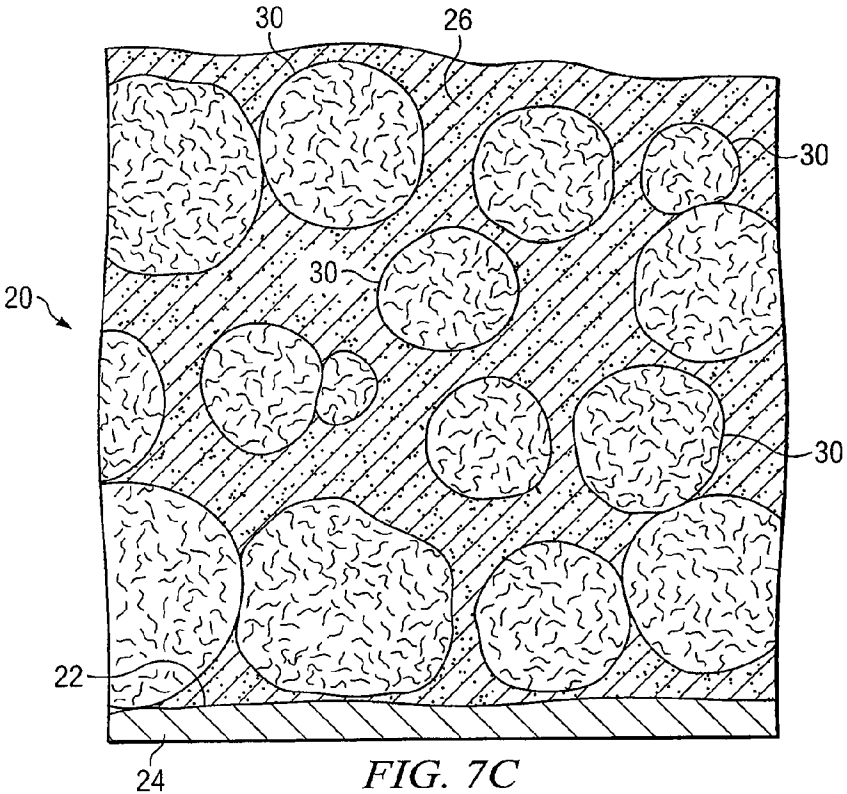
FIG. 7C is an enlarged schematic drawing in section with portions broken away showing tungsten carbide pellets formed with an optimum weight percentage of binding material dispersed within and bonded to a matrix deposit disposed on and bonded to a substrate in accordance with teachings of the present disclosure.
Figure 8C:
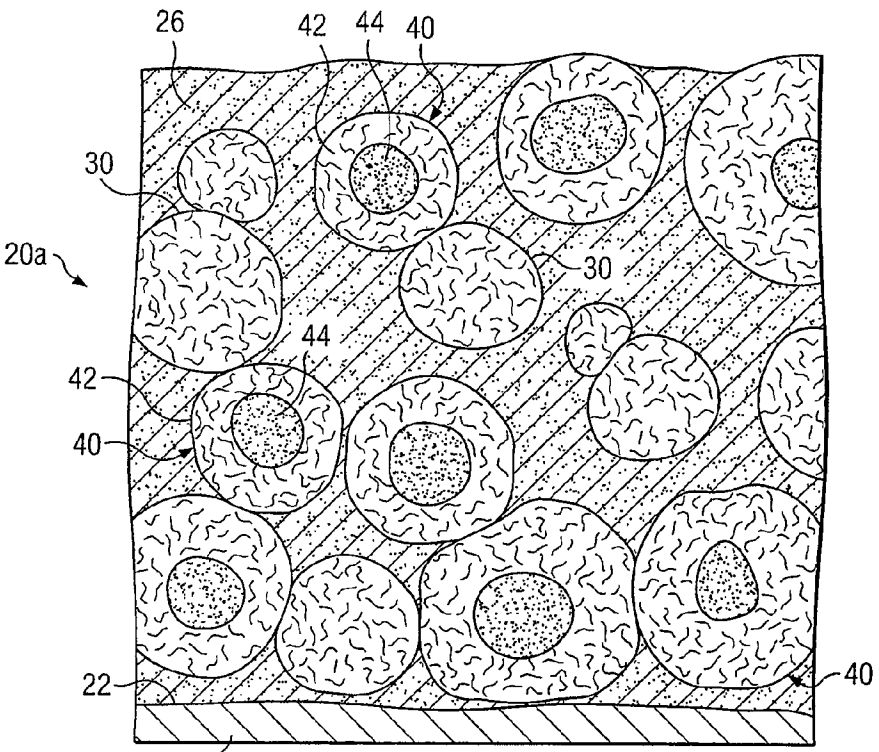
FIG. 8C is an enlarged schematic drawing in section with portions broken away showing tungsten carbide pellets formed with an optimum weight percentage of binding material along with encrusted diamond particles dispersed within and bonded to a matrix deposit disposed on and bonded to a substrate in accordance with teachings of the present disclosure.

Depending upon an intended application for matrix deposit or hardfacing 20 as shown in FIG. 7C or 8C, tungsten carbide pellets 30 may be selected within a more limited size range such as 40 U.S. Mesh to 80 U.S. Mesh. For other applications, tungsten carbide pellets 30 may be selected from two or more different size ranges such as 30 to 60 mesh and 80 to 100 mesh. Tungsten carbide pellets 30 may have approximately the same general spherical configuration. However, by including tungsten carbide pellets 30 or other hard particles with different configurations and/or mesh ranges, wear, erosion and abrasion resistance of resulting deposit matrix 20 may be modified to accommodate specific downhole operating environments associated with substrate 24.

Tungsten carbide pellets may be formed by cementing, sintering and/or HIP-sintering (sometimes referred to as "sinter-hipping") fine grains of tungsten carbide with an optimum weight percentage of binding material. Sintered tungsten carbide pellets may be made from a mixture of tungsten carbide and binding material such as cobalt powder. Other examples of binding materials include, but are not limited to cobalt, nickel, boron, molybdenum, niobium, chromium, iron and alloys of these elements. Various alloys of such binding materials may also be used to form tungsten carbide pellets in accordance with teachings of the present disclosure. The weight percentage of the binding material may be approximately four percent (4%) plus or minus one percent (1%) of the total weight of each tungsten carbide pellet.

A mixture of tungsten carbide and binding material may be used to form green pellets. The green pellets may then be sintered or HIP-sintered at temperatures near the melting point of cobalt to form either sintered or HIP-sintered tungsten carbide pellets with an optimum weight percentage of binding material. HIP-sintering may sometimes be referred to as "over pressure sintering" or as "sinter-hipping."

Sintering a green pellet generally includes heating the green pellet to a desired temperature at approximately atmospheric pressure in a furnace with no force or pressure applied to the green pellet. HIP-sintering a green pellet generally includes heating the green pellet to a desired temperature in a vacuum furnace with pressure or force applied to the green pellet.

A hot isostatic press (HIP) sintering vacuum furnace generally uses higher pressures and lower temperatures as compared to a conventional sintering vacuum furnace. For example, a sinter-HIP vacuum furnace may operate at approximately 1400° C. with a pressure or force of approximately 800 psi applied to one or more hot tungsten carbide pellets. Construction and operation of sinter-HIP vacuum furnaces are well known. The melting point of binding material used to form tungsten carbide pellets may generally decrease with increased pressure. Furnaces associated with sintering and HIP-sintering are typically able to finely control temperature during formation of tungsten carbide pellets.

Figure 4:
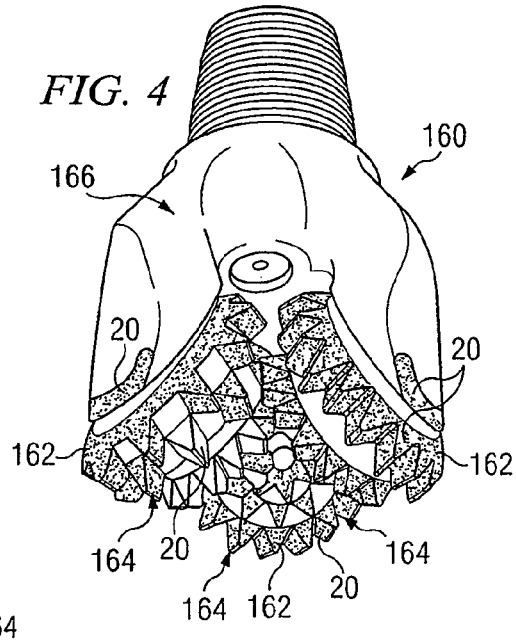
FIG. 4 is a schematic drawing showing an isometric view of a rotary cone drill bit having milled teeth with layers of hardfacing formed in accordance with teachings of the present disclosure.
Figure 9:
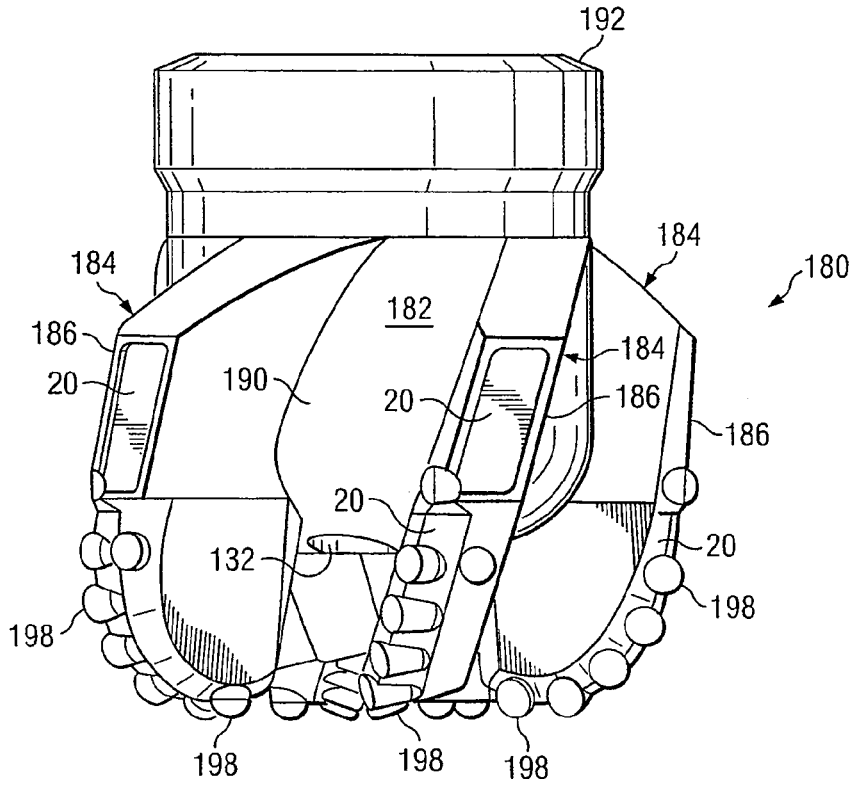
FIG. 9 is a schematic drawing in elevation showing a fixed cutter drill bit having layers of hardfacing incorporating teachings of the present disclosure.

Hardfacing incorporating teachings of the present disclosure may be placed on one or more surfaces and/or substrates associated with a wide variety of downhole tools used to form a wellbore. Such substrates may be formed from various metal alloys and/or cermets having desirable metallurgical characteristics such as machinability, toughness, heat treatability and/or corrosion resistance for use in forming a wellbore. For example, substrate 24 (see FIGS. 7C and 8C) may be formed from various steel alloys associated with manufacture of downhole tools used to form wellbores. Rotary drill bits 120, 160 and 180 as shown in FIGS. 1, 4 and 9 are representative of such downhole tools.

For purposes of explanation only, layers of hardfacing 20 formed in accordance with the teachings of the present disclosure are shown in FIGS. 1-6, 9 and 10 disposed on various types of rotary drill bits and associated cutting elements. However, hardfacing 20 incorporating teachings of the present disclosure may be disposed on a wide variety of other downhole tools (not expressly shown) which may require protection from abrasion, erosion and/or wear. Examples of such downhole tools may include, but not limited to, rotary cone drill bits, roller cone drill bits, rock bits, fixed cutter drill bits, matrix drill bits, drag bits, steel body drill bits, coring bits, underreamers, near bit reamers, hole openers, stabilizers, centralizers and shock absorber assemblies.

Surface 22 and associated substrate 24 as shown in FIGS. 7C and 8C are intended to be representative of any surface and/or substrate of any downhole tool associated with forming a wellbore that would benefit from having hardfacing incorporating teachings of the present disclosure.

Matrix deposit or hardfacing 20 may include tungsten carbide particles or pellets 30 having an optimum weight percentage of binding material in accordance with teachings of the present disclosure. Other hard materials and/or hard particles selected from a wide variety of metals, metal alloys, ceramic alloys, and cermets may be used to form matrix deposit 20. As a result of using tungsten carbide particles 30 having an optimum weight percentage of binding material, hardfacing or matrix deposit 20 may have significantly enhanced abrasion, erosion and wear resistance as compared to prior hardfacing materials.

Cutting action or drilling action of drill bits 120 and 160 may occur as respective cutter cone assemblies 122 and 162 are rolled around the bottom of a borehole by rotation of an associated drill string (not expressly shown). Cutter cone assemblies, 122 and 162 may sometimes be referred to as "rotary cone cutters" or "roller cone cutters." The inside diameter of a resulting wellbore is generally established by a combined outside diameter or gage diameter of cutter cone assemblies 122 and 162. Cutter cone assemblies 122 and 162 may be retained on a spindle by a conventional ball retaining system defined in part by a plurality of ball bearings aligned in a ball race. See for example FIGS. 2 and 5.

Rotary cone drill bits 120 and 160 are typically manufactured from strong, ductile steel alloys, selected to have good strength, toughness and reasonable machinability. Such steel alloys generally do not provide good, long term cutting surfaces and cutting faces on respective cutter cone assemblies 122 and 162 because such steel alloys are often rapidly worn away during direct contact with adjacent portions of a downhole formation. To increase downhole service life of respective rotary cone drill bits 120 and 160, deposit matrix or hardfacing 20 may be placed on shirttail surfaces, backface surfaces, milled teeth, inserts and/or other surfaces or substrates associated with respective drill bits 120 and 160. Matrix deposits 20 may also be placed on any other portions of drill bits 120 and 160 which may be subjected to intense erosion, wear and abrasion during downhole drilling operations. For some applications, many or most exterior surfaces of each cutter cone 122 and/or 162 may be covered with respective matrix deposits 20.

Figure 2:
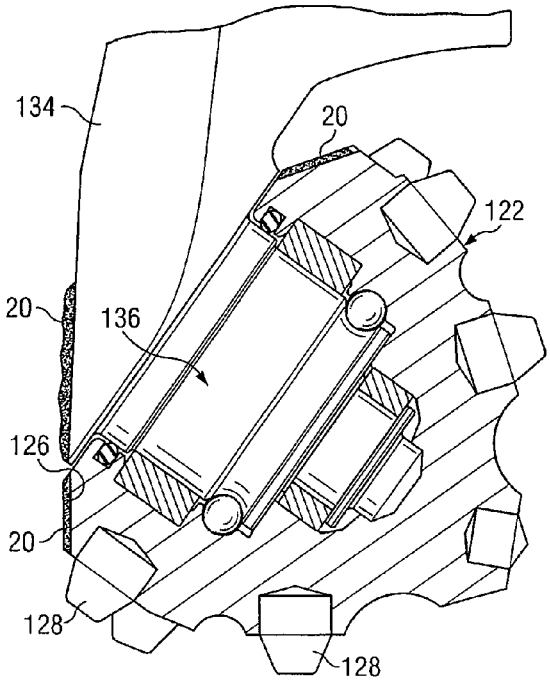
FIG. 2 is a drawing partially in section and partially in elevation with portions broken away showing a cutter cone assembly and support arm of the rotary cone bit of FIG. 1 having layers of hardfacing formed in accordance with teachings of the present disclosure.
Figure 3:
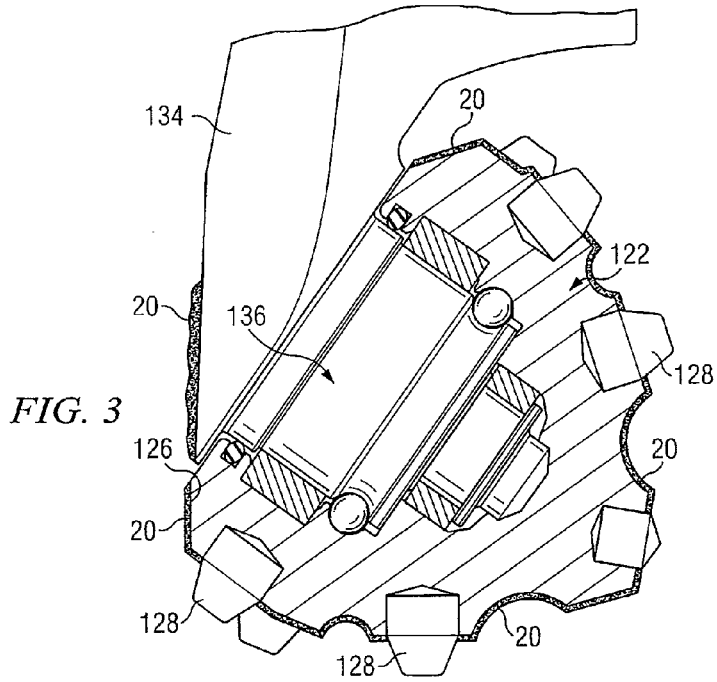
FIG. 3 is a drawing partially in section and partially in elevation with portions broken away showing the cutter cone assembly and support arm of FIG. 2 with additional layers of hardfacing formed in accordance with the teachings of the present disclosure.

Three substantially identical arms 134 may extend from bit body 124 opposite from threaded connection 86. Only two arms 134 are shown in FIG. 1. The lower end portion of each arm 134 may be provided with a bearing pin or spindle to rotatably support generally conical cutter cone assembly 122. FIGS. 2 and 3 show cutter cone assemblies 122 which have been rotatably mounted on spindle 136 extending from the lower portion of each support arm 134.

Drill bit 120 includes bit body 124 adapted to be connected by pin or threaded connection 86 to the lower end of rotary drill string (not expressly shown). Threaded connection 86 and a corresponding threaded connection of a drill string are designed to allow rotation of drill bit 120 in response to rotation of the drill string at a well surface (not shown). Bit body 124 may include a passage (not shown) that provides downward communication for drilling mud or other fluids passing downwardly through an associated drill string.

Drilling mud or other fluids may exit through one or more nozzles 132 and be directed to the bottom of an associated wellbore and then may pass upwardly in an annulus formed between the wall of the wellbore and the outside diameter of the drill string. The drilling mud or other fluids may be used to remove formation cuttings and other downhole debris from the bottom of the wellbore. The flow of drilling mud, formation cuttings and other downhole debris may erode various surfaces and substrates on bit body 124, support arms 134 and/or cone assemblies 122.

As shown in FIGS. 1, 2 and 3, hardfacing 20 may be placed on exterior surfaces of support arms 134 adjacent to the respective cutter cone assemblies 122. This portion of each support arm 134 may also be referred to as the "shirttail surface." Hardfacing 20 may also be formed on backface surface or gauge ring surface 126 of each cutter cone assembly 122. As shown in FIG. 3 the exterior surface of cutter cone assembly 122 may be completely covered with hardfacing 20 except for inserts 128.

Rotary cone drill bit 160 and bit body 166 shown in FIG. 4 may be similar to rotary cone drill bit 120 and bit body 124 as shown in FIG. 1. One difference between rotary cone drill bit 160 and rotary cone drill bit 120 may be the use of inserts 128 as part of cutter cone assemblies 122 as compared to milled teeth 164 provided by cutter cone assemblies 162.

Figure 5:
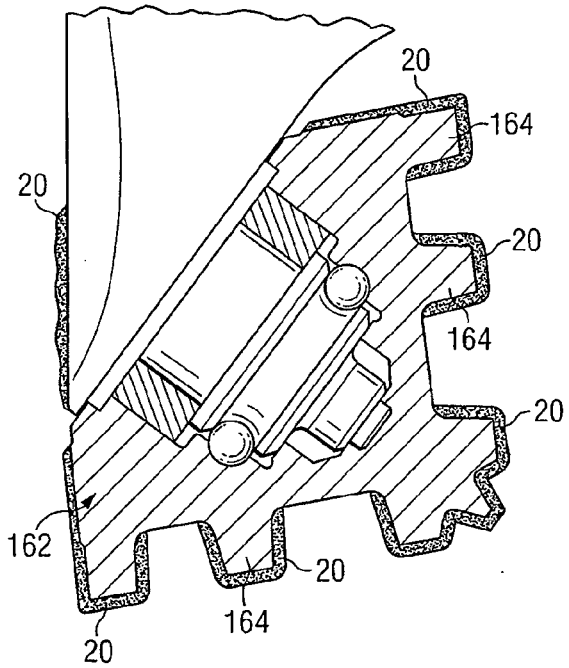
FIG. 5 is an enlarged, schematic drawing partially in section and partially in elevation with portions broken away showing a support arm and cutter cone assembly with milled teeth having layers of hardfacing formed in accordance with teachings of the present disclosure.
Figure 6:
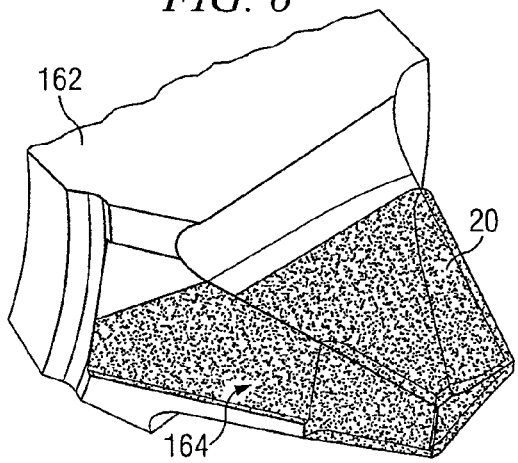
FIG. 6 is an isometric drawing with portions broken away showing a milled tooth covered with a layer of hardfacing incorporating teachings of the present disclosure.

Milled teeth 164 may be formed on each cutter cone assembly 162 in rows along the respective tapered surface of each cutter cone assembly 162. The row closest to the support arm of each cutter cone assembly 162 may be referred to as the back row or gage row. As shown in FIGS. 5 and 6 matrix deposit 20 may be applied to exterior surfaces of each milled tooth 164 in accordance with the teachings of the present disclosure.

Figure 7A:
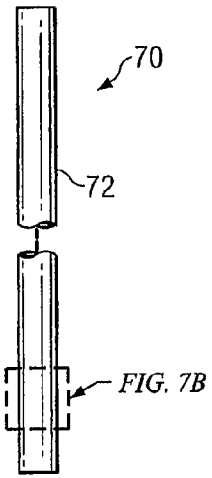
FIG. 7A is a schematic drawing in elevation with portions broken away showing a welding rod having tungsten carbide pellets and other hard materials disposed therein in accordance with teachings of the present disclosure.
Figure 7B:
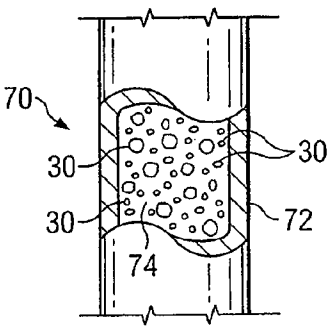
FIG. 7B is a schematic drawing in section with portions broken away showing tungsten carbide pellets and other hard materials disposed within the welding rod of FIG. 7A.
Figure 8A:
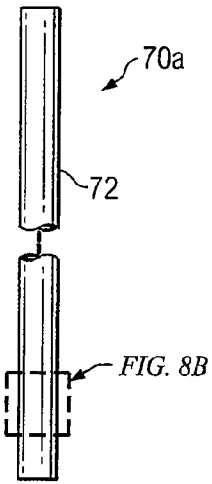
FIG. 8A is a schematic drawing in elevation with portions broken away showing a welding rod having tungsten carbide particles, encrusted diamond particles and other hard materials disposed therein in accordance with teachings of the present disclosure.
Figure 8B:
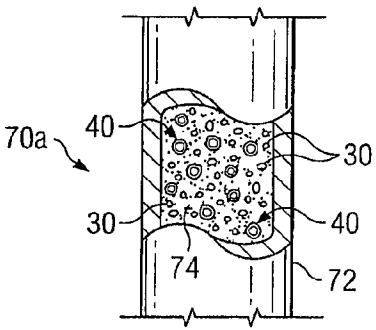
FIG. 8B is a schematic drawing in elevation and in section with portions broken away showing tungsten carbide pellets, encrusted diamond particles and other hard materials disposed within the welding rod of FIG. 8A.

Welding rod 70 as shown in FIGS. 7A and 7B may be used to form deposit matrix 20 disposed on substrate 24 as shown in FIG. 7C. Welding rod 70*a* as shown in FIGS. 8A and 8B may be used to form matrix deposit 20*a* disposed on substrate 24 as shown in FIG. 8C. Welding rods 70 and 70*a* may include respective hollow steel tubes 72 which may be closed at both ends to contain filler 74 therein.

A plurality of tungsten carbide pellets 30 having an optimum weight percentage of binding material in accordance with teachings of the present disclosure may be dispersed within filler 74. A plurality of coated diamond particles 40 may also be dispersed within filler 74 of welding rod 70*a*. Conventional tungsten carbide particles or pellets (not expressly shown) which do not have an optimum weight percentage of binder material may sometimes be included as part of filler 74. For some applications, filler 74 may include a deoxidizer and a temporary resin binder. Examples of deoxidizers satisfactory for use with the present disclosure may include various alloys of iron, manganese, and silicon.

For some applications, the weight of welding rods 70 and/or 70*a* may be approximately fifty-five percent to eighty percent filler 74 and twenty to thirty percent or more steel tube 72. Hardfacing formed by welding rods with less than approximately fifty-five percent by weight of filler 74 may not provide sufficient wear resistance. Welding rods with more than approximately eighty percent by weight of filler 74 may be difficult to use to form hardfacing.

Loose material such as powders of hard material selected from the group consisting of tungsten, niobium, vanadium, molybdenum, silicon, titanium, tantalum, zirconium, chromium, yttrium, boron, carbon and carbides, nitrides, oxides or silicides of these materials may be included as part of filler 74. The loose material may also include a powdered mixture selected from the group consisting of copper, nickel, iron, cobalt and alloys of these elements to form matrix portion 26 of matrix deposit 20. Powders of materials selected from the group consisting of metal borides, metal carbides, metal oxides, metal nitrides and other superhard or superabrasive alloys may be included within filler 74. The specific compounds and elements selected for filler 74 will generally depend upon intended applications for the resulting matrix deposit and the selected welding technique.

When tungsten carbide pellets 30 are mixed with other hard particles, such as coated diamond particles 40, both types of hard particles may have approximately the same density. One of the technical benefits of the present disclosure may include varying the percentage of binding materials associated with tungsten carbide pellets 30 and thus the density of tungsten carbide pellets 30 to ensure compatibility with coated diamond particles 40 and/or matrix portion 26 of resulting matrix deposit 20.

Tungsten carbide pellets 30 with or without coated diamond particles 40 and selected loose materials may be included as part of a continuous welding rod (not expressly shown), composite welding rod (not expressly shown), core wire (not expressly shown) and/or welding rope (not expressly shown). Oxyacetylene welding, atomic hydrogen welding techniques, tungsten inert gas (TIG-GTA), stick welding, SMAW and/or GMAW welding techniques may be satisfactorily used to apply matrix deposit 20 to surface 22 of substrate 24.

For some applications, a mixture of tungsten carbide pellets 30 and coated diamond particles 40 may be blended and thermally sprayed onto surface 22 of substrate 24 using techniques well known in the art. A laser may then be used to densify and fuse the resulting powdered mixture with surface 22 of substrate 24 to form the desired metallurgical bonds as previously discussed. U.S. Pat. No. 4,781,770 entitled "A process For Laser Hardfacing Drill Bit Cones Having Hard Cutter Inserts" shows one process satisfactory for use with the present disclosure. U.S. Pat. No. 4,781,770 is incorporated by reference for all purposes within this application.

Matrix deposit 20 as shown in FIG. 7C and matrix deposit 20*a* as shown in FIG. 8C may include a plurality of tungsten carbide particles 30 embedded or encapsulated in matrix portion 26. Various materials including cobalt, copper, nickel, iron, and alloys of these elements may be used to form matrix portion 26. For some applications matrix portion 26 may generally be described as a "steel matrix" depending upon the percentage of iron (Fe) disposed therein or a "nickel matrix" depending upon the percentage of nickel (Ni) disposed therein.

Coated diamond particles or encrusted diamond particles 40 may be formed using various techniques such as those described in U.S. Pat. No. 4,770,907 entitled "Method for Forming Metal-Coated Abrasive Grain Granules" and U.S. Pat. No. 5,405,573 entitled "Diamond Pellets and Saw Blade Segments Made Therewith." Both of these patents are incorporated by reference for all purposes within this application.

Coated diamond particles 40 may include diamond 44 with coating 42 disposed thereon. Materials used to form coating 42 may be metallurgically and chemically compatible with materials used to form both matrix portion 26 and binder for tungsten carbide pellets 30. For many applications, the same material or materials used to form coating 42 will also be used to form matrix portion 26.

Metallurgical bonds may be formed between coating 42 of each coated diamond particle 40 and matrix portion 26. As a result of such metallurgical or chemical bonds coated diamond particles 40 may remain fixed within matrix deposit 20 until the adjacent tungsten carbide pellets 30 and/or other hard materials in matrix portion 26 have been worn away. Coated diamond particles 40 may provide high levels of abrasion, erosion and wear resistance to protect associated substrate 24 as compared with hardfacing formed from only matrix portion 26 and tungsten carbide pellets 30. High abrasion, erosion and wear resistance of the newly exposed tungsten carbide pellets 30 and/or coated diamond particles 40 may increase overall abrasion, erosion and wear resistance of hardfacing 20. As surrounding matrix portion 26 continues to be worn away, additional tungsten carbide pellets 30 and/or coated diamond particles 40 may be exposed to provide continued protection and increased useful life for substrate 24.

Coated diamond particles 40 and other coated hard particles may provide a high level of erosion, abrasion and/or wear resistance for the underlying substrate 24. As the surrounding matrix portion 26 undergoes wear and abrasion, both tungsten carbide pellets 30 and coated diamond particles 40 (or other coated hard particles) may be exposed. Inherently high wear resistance of newly exposed coated diamond particles 40 and/or tungsten carbide particles 30 may significantly increases the overall erosion, abrasion and/or wear resistance of matrix deposit 20*a*. Additional information about coated or encrusted diamond particles and other hard particles may be found in U.S. Pat. No. 6,469,278 entitled "Hardfacing Having Coated Ceramic Particles Or Coated Particles Of Other Hard Materials;" U.S. Pat. No. 6,170,583 entitled "Inserts And Compacts Having Coated Or Encrusted Cubic Boron Nitride Particles;" U.S. Pat. No. 6,138,779 entitled "Hardfacing Having Coated Ceramic Particles Or Coated Particles Of Other Hard Materials Placed On A Rotary Cone Cutter" and U.S. Pat. No. 6,102,140 entitled "Inserts And Compacts Having Coated Or Encrusted Diamond Particles."

The ratio of coated diamond particles 40 or other hard particles with respect to tungsten carbide pellets 30 disposed within matrix deposit 20 may be varied to provide desired erosion, abrasion and wear protection for substrate 24 depending upon anticipated downhole operating environment. For some extremely harsh environments, the ratio of coated diamond particles 40 to tungsten carbide particles 30 may be 10:1. For other downhole drilling environments, the ratio may be substantially reversed.

Matrix deposit 20 may be formed on and bonded to working surface 22 of substrate 24 using various techniques associated with conventional tungsten carbide hardfacing. As a result of the present disclosure, tungsten carbide pellets 30 having an optimum binder weight percentage may be incorporated into a wide variety of hardfacing materials without requiring any special techniques or application procedures.

For many applications, matrix deposit 20 may be applied by welding techniques associated with conventional hardfacing. During the welding process, surface 22 of substrate 24 may be heated to melt portions of substrate 24 and form metallurgical bonds between matrix portion 26 and substrate 24. In FIGS. 7C and 8C surface 22 is shown with a varying configuration and width to represent the results of an associated welding process and resulting metallurgical bond.

Forming tungsten carbide pellets 30 with an optimum weight percentage of binder may substantially reduce and/or eliminate cracking and/or fracturing of tungsten carbide pellets 30 as a result of heating during an associated with the welding process. Appropriate metallurgical bonds may be formed between tungsten carbide pellets 30 and adjacent portions of matrix 26. Limiting the percentage of binding material used to form tungsten carbide pellets to less than five percent (5%) of the total weight of each tungsten carbide pellet 30 may substantially reduce or eliminate possibly dissolving or absorbing the binding material in matrix material 26.

Tube rod welding with an oxyacetylene torch (not shown) may be satisfactorily used to form metallurgical bonds between matrix deposit 20 and substrate 24 and metallurgical and/or mechanical bonds between matrix portion 26 and tungsten carbide pellets 30. For other applications, laser welding techniques may be used to form matrix deposit 20 on substrate 24.

Matrix deposit 20 may be formed on substrate 24 using plasma spray techniques and/or flame spray techniques, which are both associated with tungsten carbide and other types of hardfacing. Plasma spray techniques typically form a mechanical bond between the resulting hardfacing and the associated substrate. Flame spraying techniques also typically form a mechanical bond between the hardfacing and the substrate. For some applications, a combination of flame spraying and plasma spraying techniques may also be used to form a metallurgical bond between matrix deposit 20 and substrate 24. In general, hardfacing techniques which produce a metallurgical bond are preferred over those hardfacing techniques which provide only a mechanical bond between matrix deposit 20 and substrate 24.

For still other applications tungsten carbide pellets 30 may be glued or attached to surface 22 of substrate 24 using water-glassed techniques. Various types of hardfacing materials in powder form may then be applied over tungsten carbide pellets 30 to provide matrix portion 26 of matrix deposit 20. By sintering tungsten carbide pellets 30 with a weight percentage of associated binding material between three percent (3%) or greater and less than five percent (5%), matrix deposit 20 may be formed by any of techniques suitable for applying hardfacing to substrate 24 with tungsten carbide pellets 30 dispersed throughout the resulting matrix deposit 20.

Figure 10:
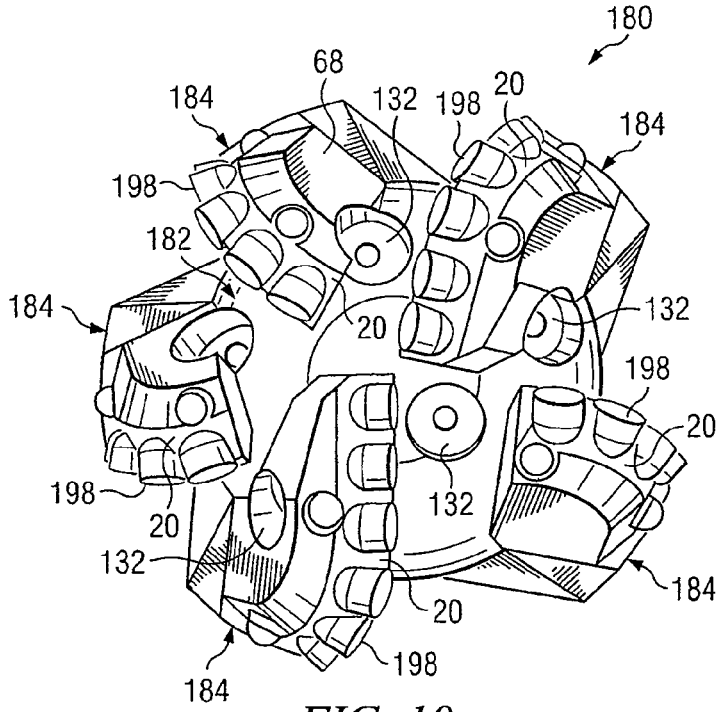
FIG. 10 is a schematic drawing showing an end view of the drill bit of FIG. 9.

FIGS. 9 and 10 are schematic drawings showing one example of a fixed cutter drill bit having one or more layers of hardfacing incorporating teachings of the present disclosure. Rotary drill bit 180 as shown in FIGS. 9 and 10 may sometimes be referred to as a "fixed cutter drill bit," "drag bit" or "steel bodied fixed cutter drill bit." Additional information concerning rotary drill bit 180 may be found in U.S. Pat. No. 5,988,303 entitled "Gage Face Inlay For Bit Hardfacing."

For applications such as shown in FIGS. 9 and 10 rotary drill bit 180 may include bit body 182 with a plurality of blades 184 extending therefrom. An appropriate threaded connection (not expressly shown) may be formed proximate end 192 of bit body 182 for use in releasably attaching rotary drill bit 180 with an associated drill string. For embodiments such as shown in FIGS. 9 and 10 rotary drill bit 180 may have five (5) blades 184. For some applications the number of blades disposed on a rotary drill bit incorporating teachings of the present disclosure may vary between four (4) and eight (8) blades or more. Respective junk slots 190 may be formed between adjacent blades 184. The number, size and configurations of blades 184 and junk slots 190 may be selected to optimize flow of drilling fluid, formation cutting and downhole debris from the bottom of a wellbore to an associated well surface.

Cutting action or drilling action associated with drill bit 180 may occur as bit body 182 is rotated relative to the bottom (not expressly shown) of a wellbore in response to rotation of an associated drill string (not expressly shown). The associated drill string may apply weight to rotary drill bit 180 sometimes referred to as "weight on bit" or "WOB." Cutting elements 198 disposed on associated blades 184 may contact adjacent portions of a downhole formation (not expressly shown). The inside diameter of an associated wellbore may be generally defined by a combined outside diameter or gage diameter determined at least in part by respective gage portions 186 of blades 184.

Bit body 182 may be formed from various steel alloys having desired strength, toughness and machinability. Such steel alloys generally do not provide good, long-term cutting surfaces for contact with adjacent portions of a downhole formation because such steel alloys are often rapidly worn away during contact with downhole formation materials. To increase downhole drilling life of rotary drill bit 180, matrix deposit or hardfacing 20 may be disposed on various portions of blades 184 and/or exterior portions of bit body 182. For example, matrix deposit or hardfacing 20 may also be disposed in junk slots 190 formed between adjacent blades 184. Matrix deposit 20 may also be placed on any other portion of drill bit 180 which may be subjected to erosion, abrasion and/or wear during downhole drilling operations.

Bit body 182 may include a passageway (not expressly shown) that provides downward communication for drilling muds or other fluids passing downwardly through an associated drill string. Drilling mud or other fluids may exit through one or more nozzles 132. The drilling mud or other fluids may then be directed towards the bottom of an associated wellbore and then may pass upwardly in an annulus formed between a sidewall of the wellbore and the outside diameter of the drill string. One or more nozzles 132 may also be provided in bit body 182 to direct the flow of drilling fluid therefrom.

Cutting elements 198 may include a respective cutting surface or cutting face oriented to engage adjacent portions of a downhole formation during rotation of rotary drill bit 180. A plurality of matrix deposits or hardfacings 20 may be disposed on exterior portions of blades 184 and/or exterior portions of bit body 182. For example, respective matrix deposits 20 may be disposed on gage portion 186 of each blade 184.

Figure 11:
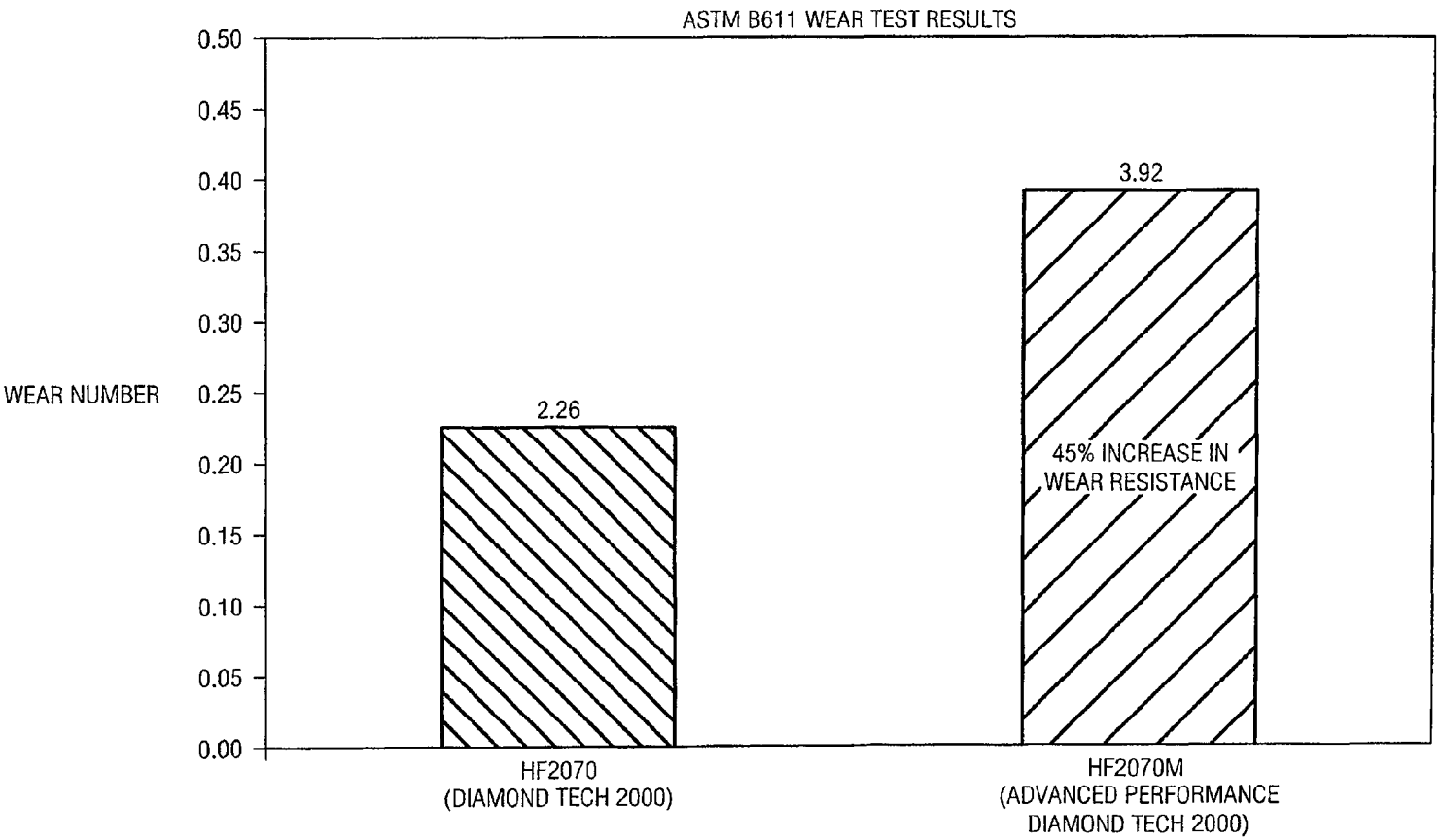
FIG. 11 is a graph showing results of wear testing products with and without hard materials incorporating teachings of the present disclosure.

FIG. 11 is a graph showing improved wear resistance associated with forming hardfacing layers with tungsten carbide pellets incorporating teachings of the present disclosure. Wear testing was conducted on six samples of hardfacing with tungsten carbide pellets having approximately 6%±1% of binder material (HF 2070) and six samples of hardfacing with tungsten carbide pellets having approximately 4%±1% of binder material. ASTM International Standard ASTM B611-85 (2005) Standard Test Method for Abrasive Wear Resistance of Cemented Carbides was used to conduct such wear testing. As shown in FIG. 11 hardfacing layers with tungsten carbide pellets having approximately 6%±1% of binder material had an average wear number of 2.26. Hardfacing layers with tungsten carbide pellets having approximately 4%±1% of binder material had an average wear number of 3.92 or an increase of approximately 45% in wear resistance.

Although the present disclosure has been described with several embodiments, various changes and modifications may be suggested to one skilled in the art. It is intended that the present disclosure encompass such changes and modifications as fall within the scope of the present appended claims.

Schedule A

ASTM B611 Wear Test Results

| | Sample # | Final Wear #, krev/cm3 |
|---|---|---|
| HF2070 (Diamond Tech 2000) | 2070-1 | 2.32 |
| | 2070-2 | 2.24 |
| | 2070-3 | 2.48 |
| | 2070-4 | 2.25 |
| | 2070-5 | 2.05 |
| | 2070-6 | 2.24 |
| | Average | 2.26 |
| HF2070M (Advanced Performance Diamond Tech 2000) | 2070M-1 | 3.75 |
| | 2070M-2 | 4.08 |
| | 2070M-3 | 3.52 |
| | 2070M-4 | 3.92 |
| | 2070M-5 | 4.04 |
| | 2070M-6 | 4.24 |
| | Average | 3.92 |

The respective layers of hardfacing used in each of the above test samples included coated diamond particles or encrusted diamonds dispersed in substantially the same metallic matrix deposit. Samples of HF 2070 hardfacing included tungsten carbide pellets with a higher percentage of binder material (6% cobalt±1%) as compared to samples of HT 2070M hardfacing with a lower percentage of binder material (4% cobalt±1%) in accordance with teachings of the present disclosure.

Schedule A (Continued)

Diamond Tech 2000™ hardfacing (HF 2070) with tungsten carbide pellets having 6% plus or minus 1% or more binding material is available from Halliburton Company on a wide variety of rotary drill bits and other types of downhole tools.

Advanced Performance Diamond Tech 2000™ (HF 2070M) hardfacing which includes tungsten carbide pellets with 4% plus or minus 1% binder material has been developed by Halliburton Company for use on a wide variety of rotary drill bits and other types of downhole tools in accordance with teachings of the present disclosure.

What is claimed is:

1. A rotary cone drill bit having at least one row of milled teeth with at least one tooth comprising;

a tip, a base, two opposing side surfaces extending between the tip and the base;

a front surface intermediate the side surfaces and extending between the tip and the base;

a back surface intermediate the side surfaces and opposite the front surface;

a layer of hardfacing applied on at least one surface of the at least one tooth;

the hardfacing having a plurality of tungsten carbide pellets dispersed within and bonded to a matrix deposit; and each tungsten carbide pellet formed with respective binding material in a range of approximately three percent (3%) or greater and less than five percent (5%) of the total weight of each tungsten carbide pellet.

2. The rotary cone drill bit of claim 1 further comprising the binding material used to form tungsten carbide pellets selected from the group consisting of cobalt, nickel, boron, molybdenum, niobium, chromium, iron, alloys of these elements and combinations of these elements and alloys.

3. The rotary cone drill bit of claim 1 wherein at least one of the tungsten carbide pellets comprises a spherical tungsten carbide particle formed in part from fine tungsten carbide grains bound together by the binding material.

4. The rotary cone drill bit of claim 1, wherein the hardfacing further comprises a plurality of spherical cast carbides dispersed within and bonded to the matrix deposit.

5. The rotary cone drill bit of claim 1 further comprising the tungsten carbide pellets having a size in a range of approximately 12 to 100 mesh.

6. The rotary cone drill bit of claim 1, wherein the matrix deposit further comprises a plurality of coated diamond particles dispersed therein.

7. The rotary cone drill bit of claim 1 wherein the matrix deposit further comprises material selected from the group consisting of cobalt, copper, nickel, iron and alloys of these elements.

8. The rotary drill bit of claim 1 further comprising at least one of the tungsten carbide pellets formed by sinter hot isostatic pressing the binding material and the tungsten carbide.

9. A rotary cone drill bit for forming a borehole, comprising:

a bit body having an upper end portion adapted for connection to a drill string for rotation of the bit body;

a number of support arms extending from the bit body, each of the support arms having a leading edge, a trailing edge and an exterior surface disposed there between;

a number of cutter cone assemblies equaling the number of support arms and rotatably mounted respectively on the support arms projecting generally downwardly and inwardly with respect to each associated support arm;

a layer of hardfacing formed on exterior surfaces of each support arm; the hardfacing having a plurality of spherical tungsten carbide particles dispersed within and bonded to a metallic matrix deposit;

each spherical tungsten carbide particle formed with a respective metal binder; and the metal binder representing between approximately three percent (3%) or greater and less than five percent (5%) of the total weight of each tungsten carbide pellet.

10. The rotary drill bit of claim 9 further comprising the metal binding material selected from the group consisting of cobalt, nickel, boron, molybdenum, chromium and iron.

11. The rotary drill bit of claim 9 wherein at least one of the spherical tungsten carbide particles comprises a tungsten carbide pellet.

12. The rotary drill bit of claim 9 wherein the hardfacing further comprises additional spherical cast carbides dispersed within and bonded to the metallic matrix deposit.

13. The rotary drill bit of claim 9 further comprising the spherical tungsten carbide particles having a mesh size in a range of approximately 12 to 100 mesh.

14. The rotary drill bit of claim 9 wherein the hardfacing further comprises a plurality of coated diamond pellets dispersed therein.

15. The rotary cone drill bit of claim 9 wherein the metallic matrix deposit further comprises material selected from the group consisting of cobalt, copper, nickel, iron and alloys of these elements.

16. The rotary cone drill bit of claim 9 wherein at least one cutter cone assembly comprises:

a generally conical metal body having a central axis, a tip having a plurality of inserts protruding therefrom and a base connected to the tip to form the body;

a cavity formed in the body along the axis and opening from the base into the tip;

an annular backface formed on an outer portion of the base;

the backface having a layer of hardfacing;

the hardfacing having a plurality of spherical tungsten carbide particles dispersed within and bonded to a metallic matrix deposit;

the spherical tungsten carbide particles formed with respective metal binders; and the metal binders representing between approximately three percent (3%) or greater and to less than five percent (5%) of the total weight of each spherical tungsten carbide particle.

17. The rotary drill bit of claim 9 further comprising at least one of the spherical tungsten carbide particles formed by sinter hot isostatic pressing the metal binder with the associated tungsten carbide.

18. A downhole tool used to form a wellbore comprising:

at least portions of the downhole tool manufactured in part from a strong, ductile steel alloy;

at least one surface of the downhole tool formed from the strong, ductile steel alloy;

a layer of hardfacing applied on the at least one surface of the downhole tool;

the hardfacing having a plurality of tungsten carbide pellets dispersed within and bonded to a metallic matrix deposit; and each tungsten carbide pellet formed in part by binding material ranging between approximately three percent (3%) and less than five percent (5%) of the total weight of each tungsten carbide pellet.

19. The downhole tool of claim 18 selected from the group consisting of rotary cone drill bits, fixed cutter drill bits, coring bits, underreamers, near bit reamers, hole openers, stabilizers and centralizers.

20. The downhole tool of claim 18, wherein the metallic matrix deposit comprises metal alloys and cermets selected from the group consisting of metal borides, metal carbides, metal oxides, and metal nitrides.

21. The downhole tool of claim 18, further comprising the tungsten carbide pellets intermixed with a plurality of coated diamond particles.

22. The downhole tool of claim 18, further comprising:

additional hard materials intermixed with the plurality of tungsten carbide pellets; and the additional hard materials selected from the group consisting of tungsten nitrides, carbon borides, carbides, nitrides, silicides of particles, niobium, vanadium, molybdenum, silicon, titanium, tantalum, yttrium, zirconium, chromium, boron, or mixtures thereof.

23. The downhole tool of claim 18, wherein the metallic matrix deposit comprises material selected from the group consisting of copper, nickel, iron, cobalt and alloys of these elements.

24. The downhole tool of claim 18 further comprising at least one of the tungsten carbide pellets formed by sinter hot isostatic pressing the binding material and the associated tungsten carbide.

25. A fixed cutter rotary drill bit operable to form a borehole, comprising:

a bit body having an upper portion adapted for connection to a drill string for rotation of the bit body;

a number of blades disposed on and extending from the bit body;

each of the blades having a leading edge, a trailing edge and an exterior portion disposed there between;

a number of cutting elements disposed on the exterior portion of each blade;

a respective layer of hardfacing formed on the exterior portion of each blade;

the hardfacing having a plurality of spherical tungsten carbide particles dispersed within and bonded to a metallic matrix deposit;

each spherical tungsten carbide particle formed with a respective metal binder; and the metal binder representing between approximately three percent (3%) or greater and less than five percent (5%) of the total weight of each tungsten carbide particle.

26. The rotary drill bit of claim 25 further comprising:

at least one of the blades having a gage pad; and the respective layer of hardfacing disposed on the gage pad.

27. The rotary drill bit of claim 25 further comprising:

at least one of the blades having a pocket formed on the exterior portion thereof;

the pocket sized to receive one of the cutting elements therein; and the layer of hardfacing disposed on the blade adjacent to and protecting the pocket.

28. The rotary drill bit of claim 25 further comprising:

a plurality of junk slots formed between adjacent blades;

a layer of hardfacing disposed proximate at least one of the junk slots to protect the associated blades; and the hardfacing having the plurality of the tungsten carbide particles dispersed therein.

29. The rotary drill bit of claim 25 further comprising:

the bit body formed at least in part from a steel alloy;

at least one nozzle bore extending through an exterior portion of the steel body;

a layer of hardfacing disposed on the exterior portion of the bit body adjacent to the nozzle bore; and the hardfacing having a plurality of the tungsten carbide particles dispersed therein.

30. A method of hardfacing a surface of a rotary drill bit comprising:

forming tungsten carbide pellets using a binder to bond particles of tungsten carbide with each other;

limiting the percent by weight of the respective binder to approximately four percent plus or minus one percent of the total weight of each tungsten carbide pellet to provide a desired density for each tungsten carbide pellet;

progressively melting a metallic material to form a mixture of molten metal with the tungsten carbide pellets dispersed therein;

applying the mixture of the molten metal and tungsten carbide pellets to a surface of the rotary drill bit;

solidifying the molten metal to form a metallic matrix in contact with the tungsten carbide pellets and the surface; and forming metallurgical bonds between the tungsten carbide pellets and adjacent portions of the metallic matrix and forming metallurgical bonds between the metallic matrix and the surface.

31. The method of claim 30 further comprising forming at least one of the tungsten carbide pellets by sinter hot isostatic pressing the binder with the tungsten carbide.

32. A method of hardfacing a working surface of a rotary drill bit comprising:

sintering a binding material mixed with tungsten carbide to form tungsten carbide particles with the binding material representing approximately four percent (4%) plus or minus one percent (1%) of the total weight of each tungsten carbide particle;

applying heat to a mixture of the tungsten carbide particles and a hardfacing material to form molten hardfacing with the tungsten carbide particles dispersed therein;

applying the mixture of molten hardfacing and tungsten carbide particles to the working surface; and solidifying the molten hardfacing in contact with the working surface to form a plurality of metallurgical bonds between the hardfacing material and the tungsten carbide particles and a plurality of metallurgical bonds between the hardfacing material and the working surface.

33. The method of claim 32, further comprising the hardfacing material selected from the group consisting of metal borides, metal carbides, metal oxides and metal nitrides.

34. The method of claim 32 further comprising applying heat to the mixture of the tungsten carbide particles and the hardfacing material using welding techniques selected from the group consisting of tube rod welding, cored wire welding, plasma arc techniques, flame spray techniques, laser fusing and water-glassed techniques.

35. The method of claim 32 further comprising sinter hot isostatic pressing the binding material and the tungsten carbide.

36. The method of claim 32 further comprising mixing at least one conventional tungsten carbide particle formed with binding material representing greater than five percent of the total weight of the conventional tungsten carbide particle.

37. The method of claim 32 further comprising mixing at least one conventional tungsten carbide pellet formed with approximately zero percent binding material by weight of the conventional tungsten carbide particle.

38. The method of claim 32 further comprising using a welding rod to apply the mixture of molten hardfacing and tungsten carbide particles to the working surface wherein the welding rod includes a filler with the tungsten carbide particles and the hardfacing material representing between approximately fifty-five percent (55%) and eighty percent (80%) of the total weight of the welding rod.

* * * * *